US006935528B2

(12) United States Patent
Quintela

(10) Patent No.: US 6,935,528 B2
(45) Date of Patent: Aug. 30, 2005

(54) POURING SPOUT FOR CONTAINERS MADE OF METAL OR A SIMILAR MATERIAL

(76) Inventor: Enrique Garcia Quintela, Riestra, 34-5 E, Pontevedra (ES), 36001

( * ) Notice: Subject to any disclaimer, the term of this patent is extended or adjusted under 35 U.S.C. 154(b) by 4 days.

(21) Appl. No.: 10/479,863

(22) PCT Filed: May 22, 2002

(86) PCT No.: PCT/ES02/00243

§ 371 (c)(1),
(2), (4) Date: Jun. 8, 2004

(87) PCT Pub. No.: WO02/100734

PCT Pub. Date: Dec. 19, 2002

(65) Prior Publication Data

US 2004/0232166 A1 Nov. 25, 2004

(30) Foreign Application Priority Data

Jun. 8, 2001 (ES) ..... 200101334

(51) Int. Cl.[7] ..... B65D 41/32
(52) U.S. Cl. ..... 220/255
(58) Field of Search ..... 220/255

(56) References Cited

U.S. PATENT DOCUMENTS 3,298,577 A 1/1967 Chlystun
4,403,709 A 9/1983 Meins
5,819,972 A * 10/1998 Puente Pubill ..... 220/270

FOREIGN PATENT DOCUMENTS

| | | |
|---|---|---|
| DE | 2721860 | 11/1978 |
| DE | 7915879 | 10/1979 |
| DE | 8426160 | 10/1984 |
| ES | 2119646 | 10/1998 |

* cited by examiner

*Primary Examiner*—Philippe Derakshani
(74) *Attorney, Agent, or Firm*—Crowell & Moring LLP

(57) ABSTRACT

A pour spout for containers made of metal or of a similar material, the containers of which are of the type comprised of a one-piece container body which is closed at the end by means of a seamed top fitted with a pull tab and a pull strip with rivet removable in full or in part. The pull tab has a hinged turning line running diametrically to a rivet which attaches a removable flat area covering a central recess in the form of an inverted truncated cone in the can top marking an underside area on the interior defining the truncated cone-shaped spout sealed by a circular surface also recessed with the aforesaid rivet. Pulling on the pull tab removes this recessed circular surface and the area covering the recess at the same time as the side of the spout emerges to the point of reaching its maximum base diameter and the free spout tip opening is rounded inward along its entire edge.

2 Claims, 5 Drawing Sheets

POURING SPOUT FOR CONTAINERS MADE OF METAL OR A SIMILAR MATERIAL

OBJECT OF THE INVENTION

The present Utility Model is for a pour spout for containers made of metal or of a similar material.

These containers are those used for canning drinks for human consumption such as: beers, juices, colas, tonic waters, etc. which meet technical conditions suitable for their use, such as being: airtight, lightweight, affordable in cost, etc.

BACKGROUND OF THE INVENTION

These containers are generally equipped with what are known as pop-tops fitted with a pull tab and a tear strip known as earth-friendly used for opening the container.

However, the opening system by means of the pull tab and tear strip located on the top of these containers, which are also referred to as cans or tins, fails to meet the minimum conditions which can be required from the sanitary standpoint for their use and human consumption for two reasons.

On opening the container, the pull tab inevitabIy falls inside the container, the outside of the tear strip coming into contact with the can contents, such that any toxic or contaminating product which has settled on the container top then contaminates the liquid inside the container.

On pouring out the contents, it is not possible to prevent the liquid from touching the outer edge of the can top, any matter on the can top contaminating the liquid.

This entails a public health risk of contamination, since these containers are used in large quantities in nearly every country worldwide, and cases have already been reported on occasions regarding contamination due to the settling on these containers of toxic products having a direct impact on health (pesticides, fungicides, etc.). as a result of which it has been possible to relate the source of the poisioning, but in the cases of contamination which cause effects on organisms within a more or less short period of time, it is not possible to determine their source or cause.

DESCRIPTION OF THE INVENTION

The pour spout of the invention is simple in design and very easy to use, given that the user only has to pull on the ring on the can top to pull out the spout located inside the container and built into the can top.

This spout system presents the liquid inside the container from being contaminated by touching any part of the outside of the can top, including the tear strip.

In other words, the use of the spout of this invention is a replacement for the opening system employed on the current containers used for canning liquid products for human consumption in order to remedy the situation of possible cases of contamination entailed in the current closing system used.

According to the invention in question, the container or can is of the type which have a one-piece can body which is sealed by means of the seaming of a sealing disk or can top.

The sealing top has a concentric recessed form in the center and a cover of the opening of the recessed area which is attached to the can top by means of a rivet to which the pull tab is fastened.

The pull tab on the rivet part is fitted with a hinge allowing the pull tab to turn to position it at a right angle to the can top, so that, by simply pulling on the pull tab, the conformed wall comprising the spout is pulled out once the cover of the opening or of the recessed area has been simultaneously removed.

By continuing to pull on the pull tab, the spout which is shaped in the form of a truncated cone is pulled out along with a spout closure, which, when pulled again, comes off with the closure, the rivet and the pull tab, the spout being left open and ready to be used for pouring.

DESCRIPTION OF ONE PRACTICAL EMBODIMENT OF THE INVENTION

Figure 1:
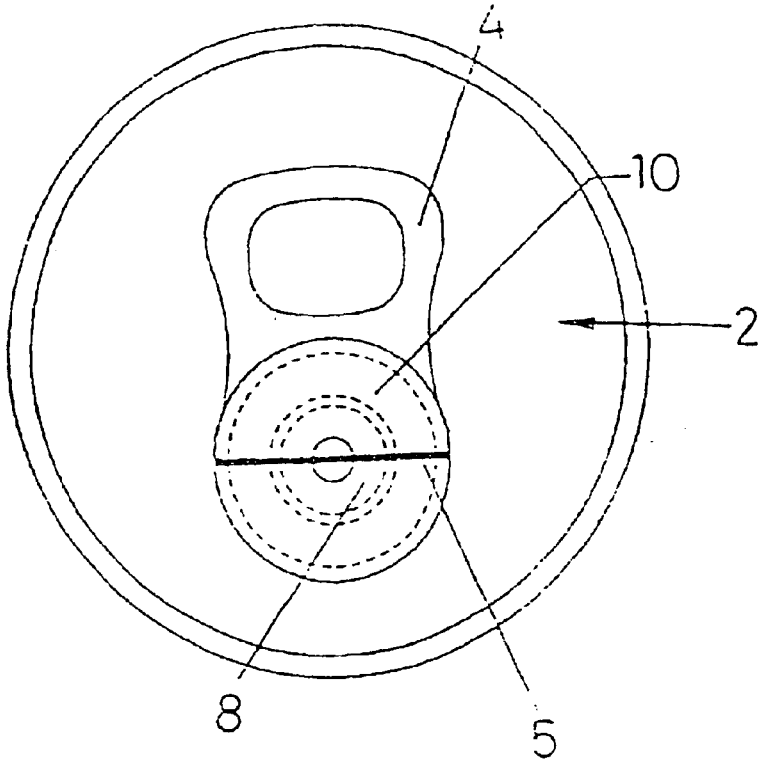
FIG. 1 shows a plan view of the object of the invention on a drink container.
Figure 2:
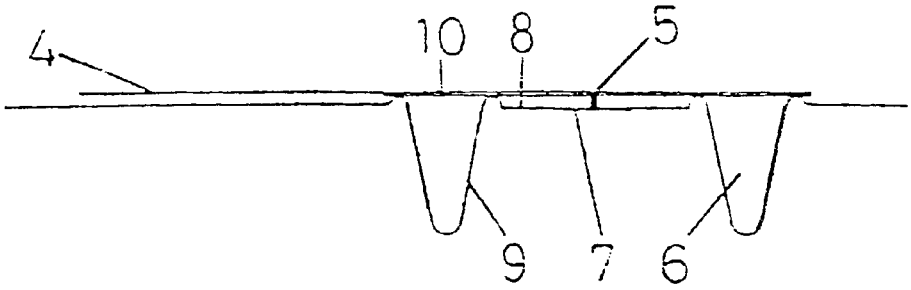
FIG. 2 shows a cross-sectional view of the spout of the invention on the inside of the drink container.

The spout 1 of the invention is positioned and is attached to the cover 2 of a one-piece container 3, the top 2 of which, which is attached by means of seaming to the end of the container body, is fitted with a pull tab 4 fitted with a hinge 5.

The can top is fitted with a minimum of one recessed inverted truncated cone 6 centered to a rivet 7 which connects the closure 8 of the spout 1 of the cover 10 of the recessed area.

Figure 3:
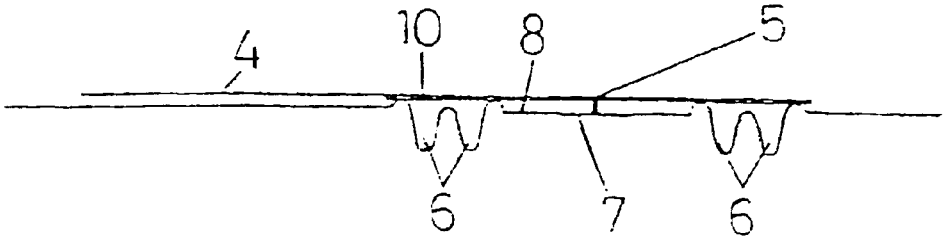
FIG. 3 shows a view similar to that of FIG. 2 of one variation of embodiment of the spout prior to its use.
Figure 4:
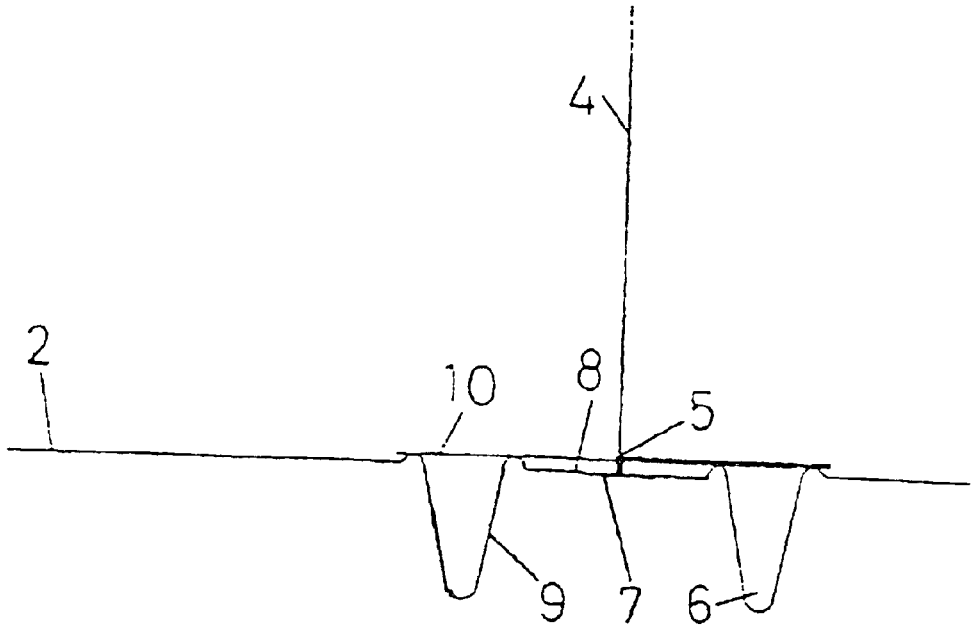
FIG. 4 shows a view of the folded spout with the pull tab raised on a vertical to the can top.

The recessed area 6 can be double, as shown in FIG. 3.

Figure 5:
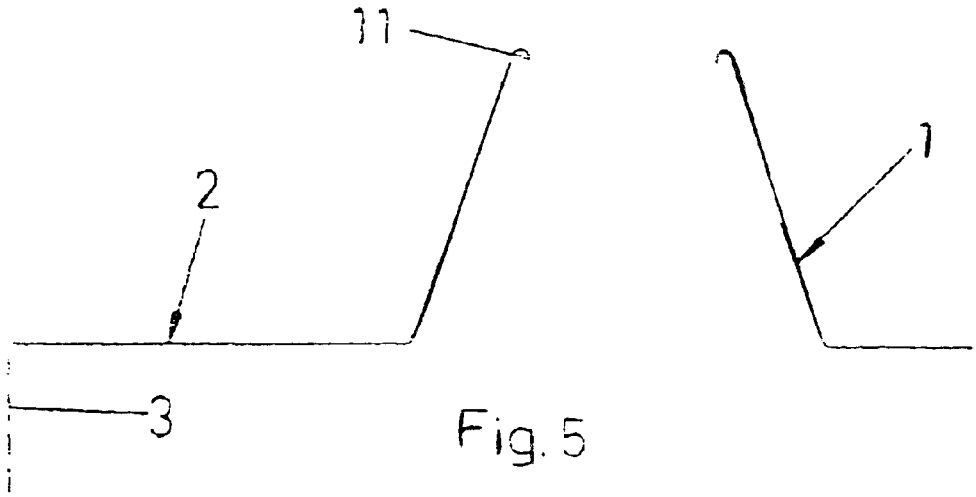
FIG. 5 shows the spout poisitoned for use.
Figure 6:
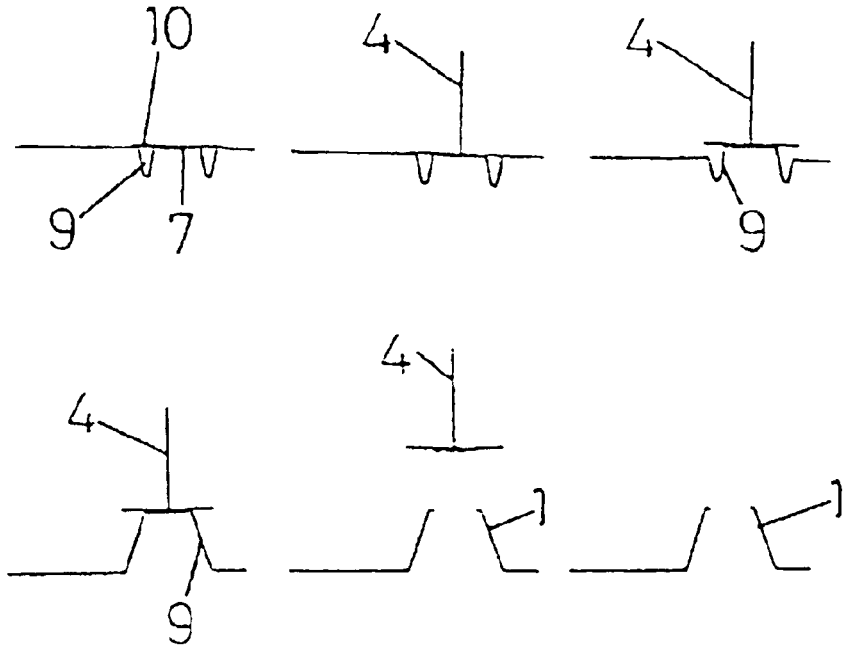
FIG. 6 shows a plan view of the container and of the spout positioned for use in FIG. 5.
Figure 7:
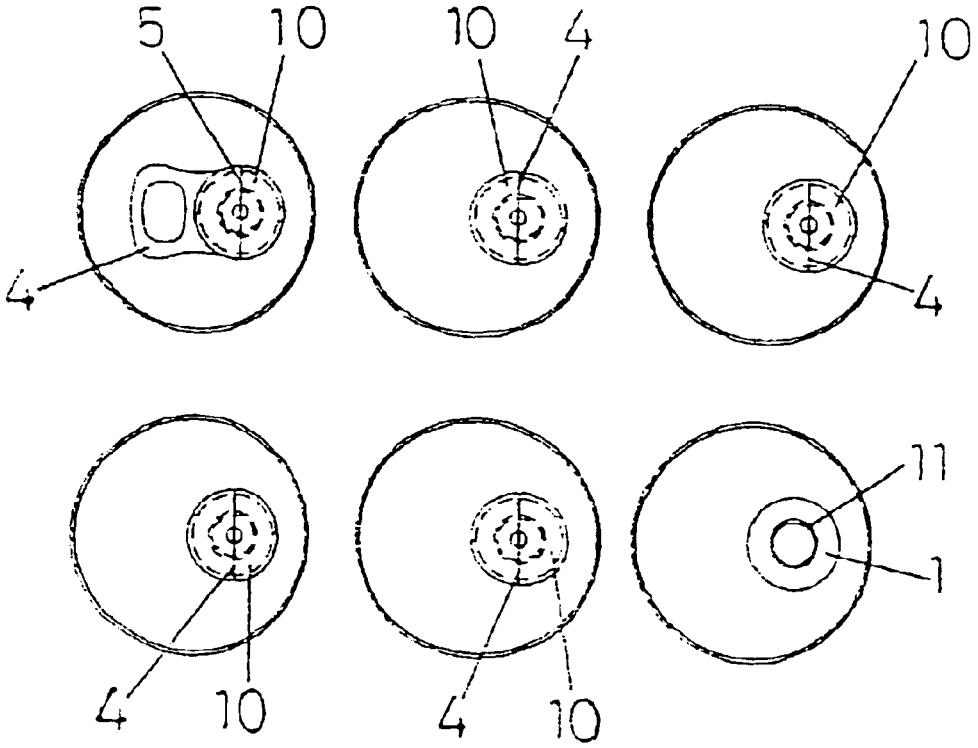
FIG. 7 shows a plan view of the sequence depicted in FIG. 6.
Figure 8:
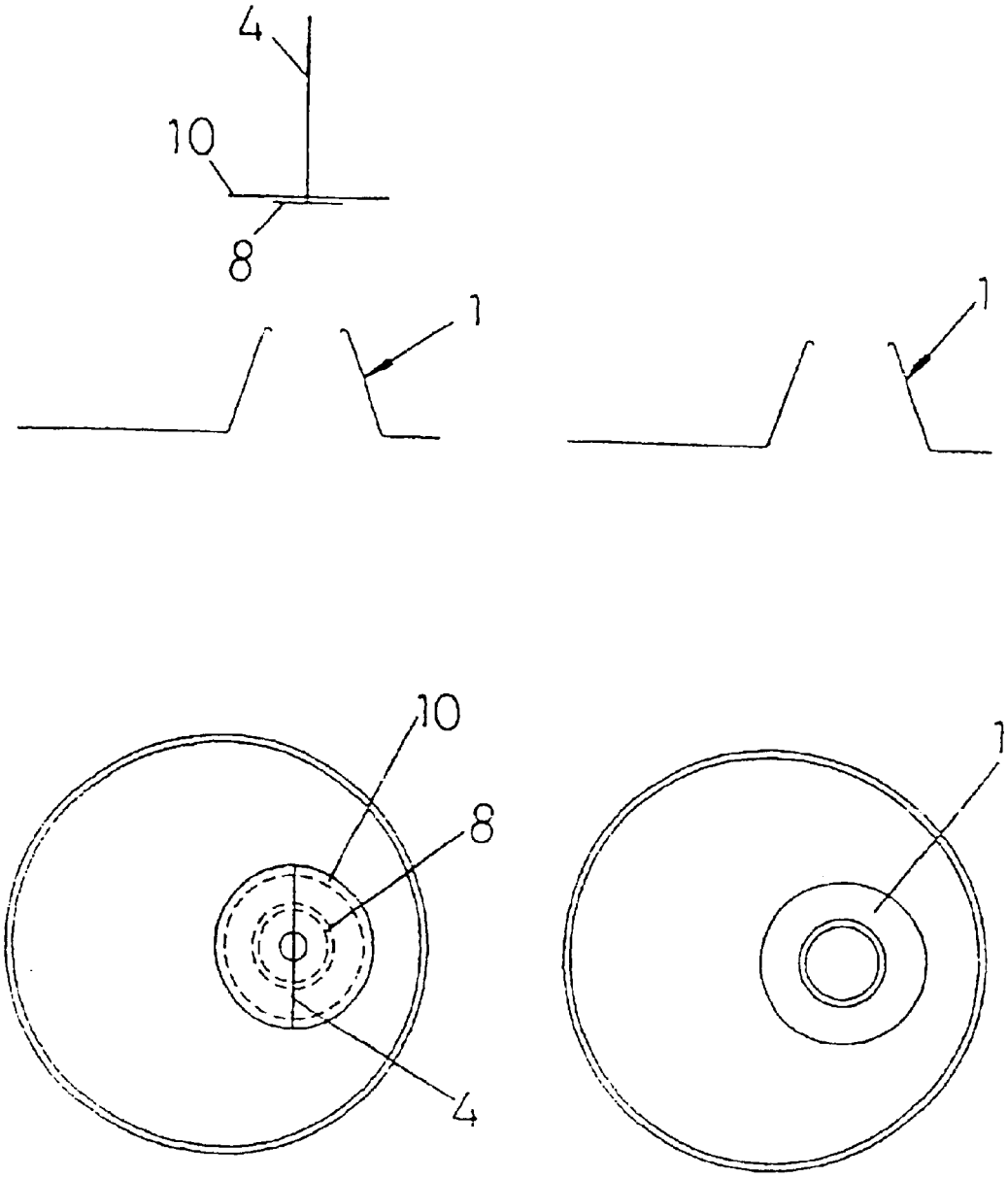
FIG. 8 shows a plan and cross-sectional view of the removal of the spout closure and of the spout pulled out.
Figure 9:
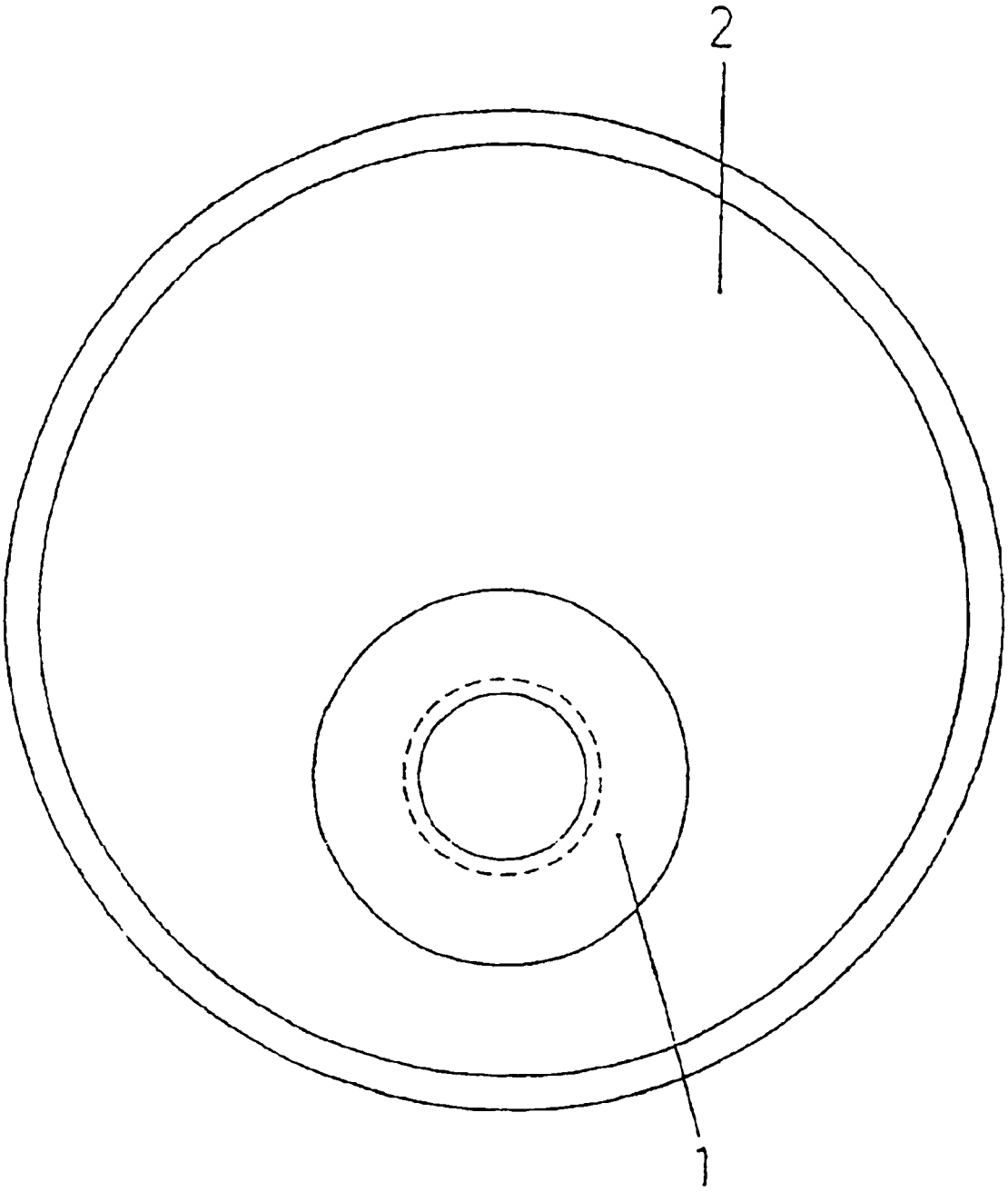
FIG. 9 shows a plan view of the spout of the invention opened and pulled out.

The rivet 7 therefore connects the cover 10 of the recessed area and the closure 8 of the side surface 9 configuring the spout 1, so that when the pull tab is pulled up into a vertical position, it comes off with the cover 10 and the closure 8 leaving the spout with one free end 11 rounded inward around the edge, as is shown is FIG. 5.

A sufficient description of the nature of the invention as well as the practical embodiment thereof having been provided, it must be said that the layouts indicated hereinabove and shown in the attached drawings are subject to modifications in detail insofar as they not alter the basic principle.

What is claimed is:

1. A pour spout for containers made of metal or of a similar material, the containers of which are of the type comprised of a one-piece container body which is closed at the end by means of a seamed top fitted with a pull tab and a pull strip with rivet removable in full or in part, characterized because the ring (4) is fitted with a hinge (5) which runs diametrically to a rivet (7), by means of which it is attached to a removable flat area (10) covering a central recess (6) in the form of an inverted truncated cone in the can top which defines the side surface (9) of a pull-out spout (1), closed by a removable circular surface (8), which is also recessed, related to the rivet (7), the free edge of the spout tip (11) being rounded inward.

2. A pour spout as per claim 1, characterized because the recess (6) which defines the pull-out spout (1) is in the shape of a concentric double inverted truncated cone.

* * * * *